US008079430B2

(12) United States Patent
Huynh et al.

(10) Patent No.: US 8,079,430 B2
(45) **Date of Patent: *Dec. 20, 2011**

(54) DRILL BITS AND TOOLS FOR SUBTERRANEAN DRILLING, METHODS OF MANUFACTURING SUCH DRILL BITS AND TOOLS AND METHODS OF OFF-CENTER DRILLING

(75) Inventors: Trung Q. Huynh, Houston, TX (US); Thorsten Schwefe, Spring, TX (US); Chad J. Beuershausen, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 264 days.

This patent is subject to a terminal disclaimer.

(21) Appl. No.: 12/428,260

(22) Filed: Apr. 22, 2009

(65) Prior Publication Data

US 2010/0270077 A1 Oct. 28, 2010

(51) Int. Cl.
*E21B 10/43* (2006.01)
*E21B 10/46* (2006.01)

(52) U.S. Cl. ..... 175/431; 175/57; 175/426

(58) Field of Classification Search ..... 175/61, 175/73, 431, 57, 426
See application file for complete search history.

(56) References Cited

U.S. PATENT DOCUMENTS

| | | | |
|---|---|---|---|
| 4,253,533 | A | 3/1981 | Baker, III |
| 4,351,401 | A | 9/1982 | Fielder |
| 4,554,986 | A | 11/1985 | Jones |
| 4,932,484 | A | 6/1990 | Warren et al. |
| 4,982,802 | A | 1/1991 | Warren et al. |
| 5,010,789 | A | 4/1991 | Brett et al. |
| 5,042,596 | A | 8/1991 | Brett et al. |
| 5,090,492 | A | 2/1992 | Keith |
| 5,238,075 | A | 8/1993 | Keith et al. |
| RE34,435 | E | 11/1993 | Warren et al. |
| 5,377,773 | A | 1/1995 | Tibbitts |
| 5,671,818 | A | 9/1997 | Newton et al. |
| 5,697,461 | A | 12/1997 | Newton et al. |

(Continued)

FOREIGN PATENT DOCUMENTS

WO 2009058808 A1 5/2009

OTHER PUBLICATIONS

PCT International Search Report for International Application No. PCT/US2008/081510, mailed Feb. 25, 2009.

(Continued)

*Primary Examiner* — Giovanna Wright
(74) *Attorney, Agent, or Firm* — TraskBritt

(57) ABSTRACT

Drill bits for subterranean drilling comprising a bit body including at least one blade that includes a blade face comprising a contact zone and a sweep zone are disclosed. In particular, drill bits including at least one blade that extends at least partially over a nose region of the bit body, a shoulder region of the bit body and a gage region of the bit body and that include a sweep zone that rotationally trails the contact zone with respect to a direction of intended bit rotation about a longitudinal axis of the bit body and include a contact zone that defines a range of about 90% to about 30% of the blade face surface area is disclosed. Additionally, drill bits comprising a sweep zone located at least partially within a gage region are disclosed. Also, methods of off-center drilling and methods of manufacturing drill bits are disclosed.

26 Claims, 5 Drawing Sheets

U.S. PATENT DOCUMENTS

| | | | |
|---|---|---|---|
| D405,811 | S | 2/1999 | Arfele et al. |
| 5,904,213 | A | 5/1999 | Caraway et al. |
| 5,967,246 | A | 10/1999 | Caraway et al. |
| 6,092,613 | A | 7/2000 | Caraway et al. |
| 6,283,233 | B1 | 9/2001 | Lamine et al. |
| 6,298,930 | B1 | 10/2001 | Sinor et al. |
| 6,460,631 | B2 | 10/2002 | Dykstra et al. |
| 7,048,081 | B2 | 5/2006 | Smith et al. |
| 7,096,978 | B2 | 8/2006 | Dykstra et al. |
| 7,836,979 | B2 | 11/2010 | Green et al. |
| 2007/0151770 | A1 | 7/2007 | Ganz |
| 2008/0289880 | A1 | 11/2008 | Majagi et al. |
| 2008/0314645 | A1 | 12/2008 | Hall et al. |
| 2009/0084606 | A1 | 4/2009 | Doster |
| 2009/0084607 | A1 | 4/2009 | Ernst et al. |

OTHER PUBLICATIONS

International Search Report for International Application No. PCT/US2010/031826, mailed Dec. 17, 2010, 3 pages.

International Written Opinion for International Application No. PCT/US2010/031826, mailed Dec. 17, 2010, 3 pages.

Written Opinion of the International Searching Authority for International Application PCT/US2008/081510, mailed Feb. 25, 2009.

DRILL BITS AND TOOLS FOR SUBTERRANEAN DRILLING, METHODS OF MANUFACTURING SUCH DRILL BITS AND TOOLS AND METHODS OF OFF-CENTER DRILLING

CROSS-REFERENCE TO RELATED APPLICATION

This application is related to U.S. patent application Ser. No. 12/260,245, filed on Oct. 29, 2008, now U.S. Pat. No. 7,836,979, issued Nov. 23, 2010, and assigned to the assignee of the present invention.

TECHNICAL FIELD

Embodiments of the invention relate to drill bits and tools for subterranean drilling and, more particularly, embodiments relate to drill bits incorporating structures for enhancing contact and rubbing area control and improved off-center drilling.

BACKGROUND

Wellbores are formed in subterranean formations for various purposes including, for example, extraction of oil and gas from subterranean formations and extraction of geothermal heat from subterranean formations. Wellbores may be formed in subterranean formations using earth-boring tools such as, for example, drill bits (e.g., rotary drill bits, percussion bits, coring bits, etc.) for drilling wellbores and reamers for enlarging the diameters of previously drilled wellbores. Different types of drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters).

To drill a wellbore with a drill bit, the drill bit is rotated and advanced into the subterranean formation under an applied axial force, commonly known as "weight-on-bit." As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Often various subs and other components, such as a downhole motor, as well as the drill bit, may be coupled together at the distal end of the drill string at the bottom of the wellbore being drilled. This assembly of components is referred to in the art as a "bottom-hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft to which the drill bit is mounted, that may be caused to rotate by pumping fluid (e.g., drilling fluid or "mud") from the surface of the formation down through the center of the drill string, through the hydraulic motor, out from nozzles in the drill bit, and back up to the surface of the formation through the annulus between the outer surface of the drill string and the exposed surface of the formation within the wellbore.

It is known in the art to use what are referred to in the art as "reamers" (also referred to in the art as "hole opening devices" or "hole openers") in conjunction with a drill bit as part of a bottom-hole assembly when drilling a wellbore in a subterranean formation. In such a configuration, the drill bit operates as a "pilot" bit to form a pilot bore in the subterranean formation. As the drill bit and bottom-hole assembly advance into the formation, the reamer device follows the drill bit through the pilot bore and enlarges the diameter of, or "reams," the pilot bore. Reamers may also be employed without drill bits to enlarge a previously drilled wellbore.

As noted above, when a wellbore is being drilled in a formation, axial force or "weight" is applied to the drill bit (and reamer device, if used) to cause the drill bit to advance into the formation as the drill bit drills the wellbore therein. This force or weight is referred to in the art as the "weight-on-bit" (WOB).

It is known in the art to employ what are referred to as "depth-of-cut control" (DOCC) features on earth-boring drill bits. For example, U.S. Pat. No. 6,298,930 to Sinor et al., issued Oct. 9, 2001 discloses rotary drag bits that include exterior features to control the depth of cut by cutters mounted thereon, so as to control the volume of formation material cut per bit rotation as well as the reactive torque experienced by the bit and an associated bottom-hole assembly. The exterior features may provide sufficient bearing area so as to support the drill bit against the bottom of the borehole under weight-on-bit without exceeding the compressive strength of the formation rock.

BRIEF SUMMARY

In some embodiments, a drill bit for subterranean drilling may comprise a bit body including a plurality of blades. At least one blade of the plurality of blades may extend at least partially over a nose region of the bit body, a shoulder region of the bit body and a gage region of the bit body and may have a blade face surface comprising a contact zone and a sweep zone. The sweep zone may rotationally trail the contact zone with respect to a direction of intended bit rotation about the longitudinal axis of the bit body and the contact zone may define a range of about 90% to about 30% of the blade face surface area.

In additional embodiments, a drill bit for subterranean drilling may comprise a bit body including a plurality of blades. At least one blade of the plurality of blades may extend at least partially over a nose region of the bit body, a shoulder region of the bit body and a gage region of the bit body and may have a blade face surface that comprises a contact zone and a sweep zone. The sweep zone may rotationally trail the contact zone with respect to a direction of intended bit rotation about the longitudinal axis of the bit body and the sweep zone may be located at least partially within the gage region of the bit body.

In further embodiments, methods of off-center drilling may comprise positioning a bit body including a longitudinal axis and at least one blade extending at least partially over a nose region of the bit body, a shoulder region of the bit body and a gage region of the bit body, within a borehole in a formation. The method may further include rotating the bit body along an axis of rotation that is different than the longitudinal axis of the bit body and positioning a leading portion of a blade face of the at least one blade into direct rubbing contact with the formation while preventing a trailing portion of the blade face from coming into direct rubbing contact with the formation.

In yet further embodiments, methods of manufacturing drill bits may comprise forming at least one blade at least partially over a nose region of a bit body, a shoulder region of the bit body and a gage region of the bit body and forming a contact zone and a sweep zone in at least a portion of a gage region of the at least one blade.

In yet additional embodiments, methods of manufacturing drill bits may comprise forming at least one blade at least partially over a nose region of a bit body, a shoulder region of the bit body and a gage region of the bit body and forming a blade face surface in the at least one blade comprising a contact zone forming a range of about 90% to about 30% of the blade face surface, and a sweep zone, which may rotationally trail the contact zone with respect to a direction of intended bit rotation.

DETAILED DESCRIPTION OF THE INVENTION

Illustrations presented herein are not meant to be actual views of any particular drill bit or other earth-boring tool, but are merely idealized representations which are employed to describe the present invention. Additionally, elements common between figures may retain the same numerical designation.

The various drawings depict an embodiment of the invention as will be understood by the use of ordinary skill in the art and are not necessarily drawn to scale. The term "sweep" as used herein is broad and is not limited in scope or meaning to any particular surface contour or construct. The term "sweep" may be replaced with any one of the following terms: "recessed," "reduced," "decreased," "cut," "diminished," "lessened," and "tapered," each having like or similar meaning in context of the specification and drawings as described and shown herein. The term "sweep" has been employed throughout the application in the context of describing the degree to which a "segment," "portion," "surface," and/or "zone" of a blade face surface may be generally removed from direct rubbing contact with a subterranean formation relative to another "segment," "portion," "surface," and/or "zone" of the blade face surface of a blade in intended rubbing contact with the subterranean formation while drilling.

Figure 1:
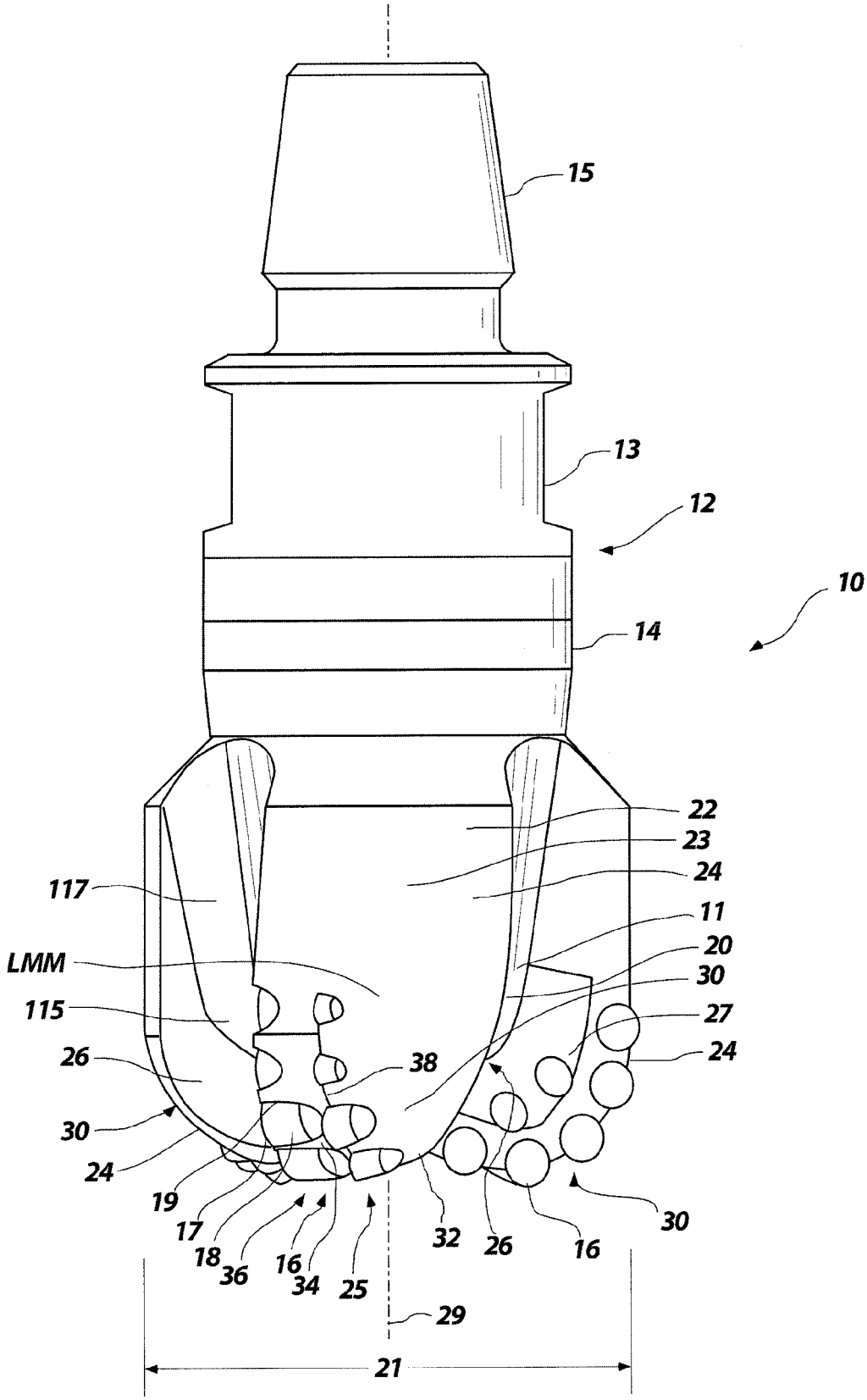
FIG. 1 shows a perspective side view of an earth-boring drill bit, according to an embodiment of the present invention.

FIG. 1 shows a perspective, side view (with respect to the usual orientation thereof during drilling) of a drill bit 10 configured with sweep zones 30, according to an embodiment of the invention. The drill bit 10 is configured as a fixed-cutter rotary full-bore drill bit, also known in the art as a "drag" bit. The drill bit 10 includes a bit crown or bit body 11 comprising, for example, tungsten carbide particles infiltrated with a metal alloy binder, a machined steel casting or forging, or a sintered tungsten or other suitable carbide, nitride or boride material as discussed in further detail below. The bit body 11 may be coupled to a support 12. The support 12 includes a shank 13 and a crossover component 14 coupled to the shank 13 in this embodiment of the invention. It is recognized that the support 12 may be made from a unitary material piece or multiple pieces of material in a configuration differing from the shank 13 being coupled to the crossover component 14 by weld joints, as described with respect to this particular embodiment. The shank 13 of the drill bit 10 includes a pin comprising male threads 15 that is configured to API standards and adapted for connection to a component of a drill string (not shown).

Blades 24 that radially and longitudinally extend from a face 20 of the bit body 11 outwardly to a full gage diameter 21 each have mounted thereon a plurality of cutting elements, generally designated by reference numeral 16. Each cutting element 16, as illustrated, comprises a polycrystalline diamond compact (PDC) table 17 formed on a cemented tungsten carbide substrate 18. The cutting elements 16, conventionally secured in respective cutter pockets 19 by brazing, for example, are positioned to cut a subterranean formation being drilled when the drill bit 10 is rotated in a clockwise direction looking down the drill string under weight-on-bit (WOB) in a borehole. In order to enhance rubbing contact control without altering the desired placement or depth-of-cut (DOC) of the cutting elements 16, or their constituent cutter profiles as understood by a person having ordinary skill in the art, a sweep zone 30 is included on each blade 24. The sweep zone 30 rotationally trails the cutting elements 16 to prescribe a sweep surface 32 over a portion of a blade face surface 25 of each associated blade 24. The prescribed, or sweep surface 32 allows a rubbing portion 34 in a contact zone 36 of the blade face surface 25 to provide reduced or engineered surface-to-surface contact when engaging a subterranean formation while drilling.

Stated another way, each sweep zone 30 may be said, in some embodiments, to rotationally reduce a portion (i.e., the sweep surface 32) of the blade face surface 25 back and away from the rotationally leading cutting elements 16 toward a rotationally trailing edge, or face 26 on a given blade 24 to enhance rubbing contact control by affording the rubbing portion 34 in the contact zone 36 of the blade face surface 25, substantially not extending into the sweep zone 30, to principally support WOB while engaging to drill a subterranean formation without exceeding the compressive strength thereof. In this regard, the recessed portion of the sweep zone 30 is substantially removed (with respect to the rubbing portion 34 of leading blade face surface 25 not extending into the sweep zone 30) from rubbing contact with a subterranean formation while drilling. Advantageously, the sweep zone 30 allows for enhanced rubbing control while maintaining conventional, or desired, features on the blade 24, such as support structure necessary for securing the cutting elements 16 (particularly with respect to obtaining, without distorting, a desired cutter profile) to the blade 24 and providing a bearing surface 23 on a gage pad 22 of the blade 24 for enhancing stability of the drill bit 10 while drilling.

Still other advantages are afforded by the sweep zone 30, such as allowing the blade face surface 25 to provide engineered weight or pressure per unit area, designed for the intended operating WOB. Each contact zone 36 of the blade face surfaces 25 substantially rotationally extends from the rotationally leading edge or face 27 of each blade 24 to a sweep demarcation line 38 (also, see FIG. 3). The sweep demarcation line 38 indicates, generally, division between where the contact zone 36 and the sweep zone 30 rotationally end and begin, respectively, and represents demarcation between substantial and insubstantial rubbing contact with a subterranean formation when drilling with the drill bit 10. Although the sweep demarcation line 38 is shown generally following the shape of the leading face 27 of the blade 24, the sweep demarcation line 38 is not limited to such a path and may be oriented along one or more of any number of paths that are independent of the shape of the leading face 27 of the blade 24. Each sweep zone 30 may be configured according to an embodiment of the invention, as further described hereinafter.

Figure 2:
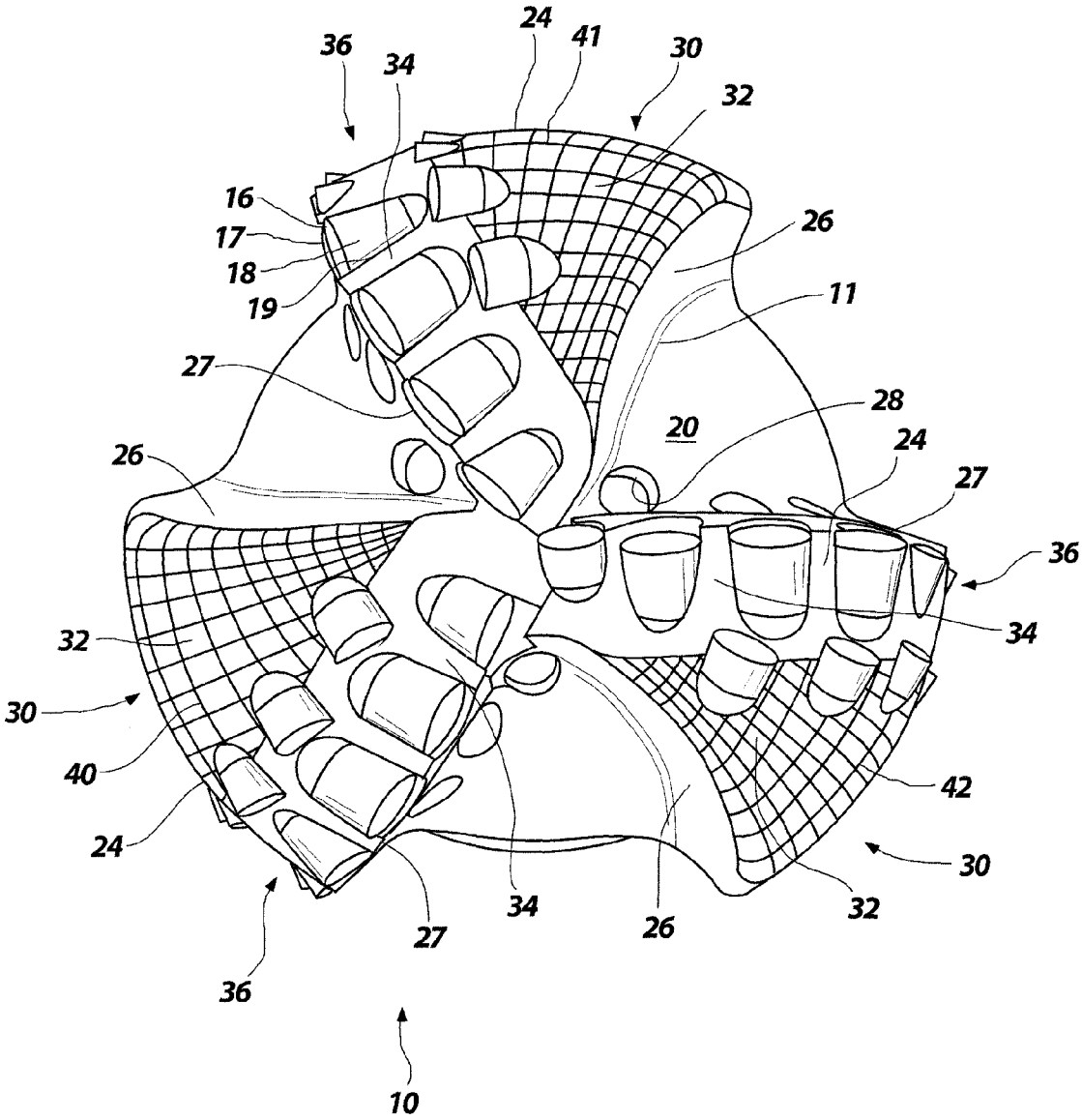
FIG. 2 shows an elevation view of a face of the earth-boring drill bit of FIG. 1.
Figure 3:
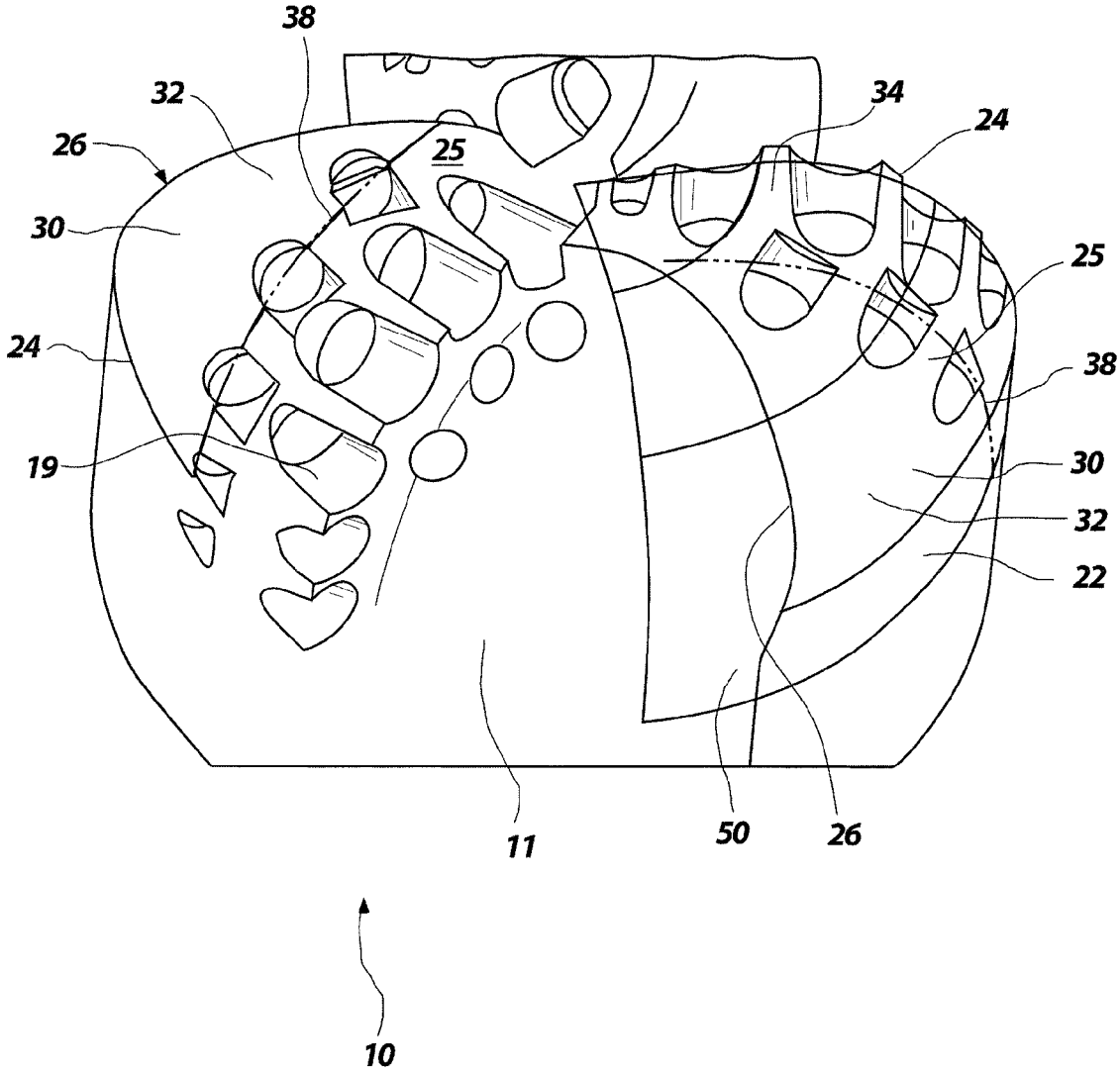
FIG. 3 shows a perspective view of a portion of a bit body of the earth-boring drill bit shown in FIG. 1.

Before describing a sweep zone 30 in further detail in accordance with the invention as shown in FIGS. 1 through 3, the drill bit 10 as shown in FIG. 1 will be first described generally in further detail. As previously mentioned, the bearing surface 23 on the gage pad 22 enhances stability of the drill bit 10 and protects the cutting elements 16 from the undesirable impact stresses caused particularly by bit whirl and lateral movement to improve stability of the drill bit 10 by reducing the propensity for lateral movement of the drill bit 10 while drilling and, in turn, any propensity of the drill bit 10 to whirl. In this regard, the bearing surface 23 of the gage pad 22 is a lateral movement mitigator (LMM) bounded by the sweep zone 30 at its full radial extent of the blade 24 adjacent to the gage pad 22 in the gage region thereof, to improve both stability and rubbing contact control of the drill bit 10 while drilling. Also, during drilling, drilling fluid is discharged through nozzles (not shown) located in ports 28 (see FIG. 2) in fluid communication with the face 20 of bit body 11 for cooling the PDC tables 17 of cutting elements 16 and removing formation cuttings from the face 20 of drill bit 10 as the fluid moves into passages 115 and through junk slots 117. The nozzles may be sized for different fluid flow rates depending upon the desired flushing required in association with each group of cutting elements 16 to which a particular nozzle assembly directs drilling fluid.

The sweep zones 30 may be formed from the material of the bit body 11 and manufactured in conjunction with the blades 24 that extend from the face 20 of the bit body 11. The material of the bit body 11 and blades 24 with associated sweep zones 30 of the drill bit 10 may be formed, for example, from a cemented carbide material that is coupled to the body blank by welding, for example, after a forming and sintering process and is termed a "cemented" bit. The cemented carbide material suitable for use in implementation of this embodiment of the invention comprises tungsten carbide particles in a cobalt-based alloy matrix made by pressing a powdered tungsten carbide material, a powdered cobalt alloy material and admixtures that may comprise a lubricant and adhesive, into what is conventionally known as a green body. A green body is relatively fragile, having enough strength to be handled for subsequent furnacing or sintering, but is not strong enough to handle impact or other stresses that may be required to prepare a finished product. In order to make the green body strong enough for particular processes, the green body is then sintered into the brown state, as known in the art of particulate or powder metallurgy, to obtain a brown body suitable for machining, for example. In the brown state, the brown body is not yet fully hardened or densified, but exhibits compressive strength suitable for more rigorous manufacturing processes, such as machining, while exhibiting a relatively soft material state to advantageously obtain features in the body that are not practicably obtained during forming or are more difficult and costly to obtain after the body is fully densified. While in the brown state for example, the cutter pockets 19, nozzle ports 28 and the sweep surface 32 of associated sweep zone 30 may also be formed in the brown body by machining or other forming methods. Thereafter, the brown body is sintered to obtain a fully dense cemented bit.

As an alternative to tungsten carbide, one or more of boron carbide, boron nitride, aluminum nitride, tungsten boride and carbides or borides of Ti, Mo, Nb, V, Hf, Zr, Ta, Si and Cr may be employed. As an alternative to a cobalt-based alloy matrix material, or one or more of iron-based alloys, nickel-based alloys, cobalt- and nickel-based alloys, aluminum-based alloys, copper-based alloys, magnesium-based alloys, and titanium-based alloys may be employed.

In order to maintain particular sizing of machined features, such as cutter pockets 19 or nozzle ports 28, displacements, as known to those of ordinary skill in the art, may be utilized to maintain nominal dimensional tolerance of the machined features, e.g., maintaining the shape and dimensions of a cutter pocket 19 or a nozzle port 28. The displacements help to control the shrinkage, warpage or distortion that may be caused during the final sintering process required to bring the green or brown body to full density and strength. While the displacements help to prevent unwanted, nominal changes in associated dimensions of the brown body during final sintering, invariably, critical component features, such as threads, may require reworking prior to their intended use, as the displacement may not adequately prevent against shrinkage, warpage or distortion.

While sweep zones 30 are formed in the cemented carbide material of the drill bit 10 of this embodiment of the invention, a drill bit may be manufactured in accordance with embodiments of the invention using a matrix bit body or a steel bit body as are well known to those of ordinary skill in the art, for example, without limitation. Drill bits, termed "matrix" bits are conventionally fabricated using particulate tungsten carbide infiltrated with a molten metal alloy, commonly copper based. Steel body bits comprise steel bodies generally machined from castings or forgings. While steel body bits are not subjected to the same manufacturing sensitivities as noted above, steel body bits may enjoy the advantages of the invention as described herein, particularly with respect to having sweep zones 30 formed or machined into the blade 24 for improving pressure and rubbing control upon the blade face surface 25 caused by WOB and for further controlling a rubbing area in contact with a subterranean formation while drilling.

The sweep zones 30 may be distributed upon or about the blade face surface 25 of respective associated blades 24 to symmetrically or asymmetrically provide for a desired rubbing area control surface (i.e., the rubbing portion 34 of the contact zone 36) upon the drill bit 10, respectively during rotation about a longitudinal axis 29.

FIG. 2 shows a face elevation view of the drill bit 10 shown in FIG. 1 configured with sweep zones 30. Reference may also be made back to FIG. 1. The sweep zones 30 advantageously enhance the degree of rubbing when drilling a subterranean formation with the drill bit 10 by controlling the amount of sweep applied to the sweep surface 32 to effect reduced rubbing engagement over a portion of rotationally trailing portion of blade face surface 25 of each blade 24 when drilling. Sweep zones 30 are included upon the blade face surface 25 of each blade 24 forming a rotationally symmetric structure as illustrated by overlaid grids, indicated by numerical designations 40, 41 and 42. The overlaid grids 40, 41 and 42 form no part of the drill bit 10, but are representative of the sweep zone 30 as described with respect to FIG. 2. Each sweep zone 30 includes a sweep surface 32 of a blade face surface 25 as represented by numerical designations 40, 41 and 42, allowing the remaining portion of the blade face surface 25 (i.e., the rotationally leading rubbing portion 34 of the blade face surface 25) to principally engage, in rubbing contact, the formation while drilling. It is recognized that each sweep zone 30 may be asymmetrically oriented upon the surface of the blade face surface 25 different from the symmetrically oriented sweep zone 30 as illustrated, respectively. Moreover, it is to be recognized that each sweep surface 32 may have, to a greater or lesser extent, a total surface area that is different from the equally sized sweep surfaces 32 as illustrated, respectively.

FIG. 3 shows a partial, perspective view of a bit body 11 of the drill bit 10 as shown in FIG. 1 configured with sweep zones 30. The bit body 11 in FIG. 3 is shown without cutting elements affixed into the cutter pockets 19. Representatively, the sweep zone 30 rotationally sweeps, in order to reduce the amount of intended rubbing contact with the drill bit 10, a sweep surface 32 of the blade face surface 25 below a conventional envelope comprising the blade face surface 25 as illustrated by numerical designation 50. The envelope 50 forms no part of the drill bit 10, but is illustrative of the degree to which the underlying sweep surface 32 of the sweep zone 30 is rotationally receded, in both lateral and radial extent, in order to reduce, by controlling, the extent to which rubbing contact occurs when drilling a subterranean formation. It is noted that the envelope 50 shows the extent to which rubbing contact may persist, particularly upon the gage pad 22 of the blade 24 and the rubbing portion 34 of the blade face surface 25 of the blade 24. In this embodiment, each sweep surface 32 of the sweep zones 30, respectively, are uniformly rotationally reduced (laterally and radially) by fifty-eight thousands of an inch (0.058") at respective rotationally trailing faces 26 of the blades 24 beginning from respective sweep demarcation lines 38 of the blade face surfaces 25. It is to be recognized that the extent to which the sweep surface 32 is recessed with respect to the rubbing portion 34 may be greater or lesser than the fifty-eight thousands of an inch, as illustrated. Moreover, the geometry over which the sweep surface 32 is recessed within the sweep zone 30 may be irregular, stepped, or non-uniform, from the longitudinal axis 29 (see FIG. 1) of the bit body 11 and around the length of the sweep zone 30, from the uniform sweep surface 32 as illustrated.

In embodiments of the invention, a sweep surface 32 may be provided in a sweep zone 30 upon one or more blades 24 to reduce the amount of rubbing over the blade face surface 25. In this respect, the amount of desired rubbing may be controlled by a rubbing portion 34 in the contact zone 36 of the blade face surface 25, while advantageously maintaining, without distorting, a desired cutter exposure associated with the cutting elements 16 and cutter profile (not shown) associated therewith. The sweep surface 32 may extend continuously, as seen in FIGS. 1 through 3, or discontinuously over the cone region, the nose region and the shoulder region substantially extending to the gage region of the drill bit 10.

In other embodiments of the invention, multiple sweep surfaces 32 may be provided in a sweep zone 30 upon one blade 24 of a drill bit 10 or upon a plurality of blades 24 on a drill bit 10. Each of the multiple sweep surfaces 32 may rotationally trail an adjacent rubbing portion 34 of a contact zone 36 of a bit being concentrated in at least one of the cone region, the nose region and the shoulder region of the drill bit 10.

It is recognized that a sweep zone 30 in accordance with any of the embodiments of the invention mentioned herein, may be configured with any conceivable geometry that reduces the amount of rubbing exposure of a sweep surface in order to provide a degree of controlled rubbing upon a rubbing portion of a blade face surface of a blade without substantially affecting cutting element exposure, cutter profile and cutter placement thereupon. Advantageously, the degree of controlled rubbing may provide enhanced stability for the bit, particularly when subjected to dysfunctional energy caused or induced by WOB.

In further embodiments, a drill bit includes a controlled or engineered rubbing surface for a blade face surface of a blade of a bit body in order to reduce the amount of rubbing contact, particularly in at least one of the cone region, nose region and shoulder region of the blade, with a formation. The controlled or engineered rubbing surface for the blade face surface provides, without sacrificing cutting element exposure and placement, a degree of rubbing that may be controlled by an amount of sweep applied to a trailing portion of the blade face surface of the blade.

It is recognized that the blade face surface of the blade of the bit body may be formed in a casting process or machined in a machining process to construct the bit body, respectively. The invention, generally, adds a detail to the face of a blade that "sweeps" rotationally across the surface of the face of the blade to provide a geometry capable of limiting the amount of rubbing contact seen between the face of the blade and a subterranean formation while also providing for, or maintaining, conventional cutting element exposures and cutter profiles.

In other embodiments, a drill bit includes a controlled or engineered rubbing surface on a blade face surface in order to provide an amount of rubbing control for increasing the rate-of-penetration while combining structure for increased stability while drilling in a subterranean formation. This structure is disclosed in U.S. patent application Ser. No. 11/865,296, titled "Drill Bits and Tools For Subterranean Drilling," filed Oct. 1, 2007, pending, and U.S. patent application Ser. No. 11/865,258, titled "Drill Bits and Tools For Subterranean Drilling," filed Oct. 1, 2007, pending, which are owned by the assignee of the present invention, and the disclosures of which are incorporated herein, in their entirety, by reference.

In some embodiments, one or more blades 24 may include at least one sweep zone 30 formed in the shoulder region of the face 20, which may optionally extend into the gage region of the blade 24. Additionally, embodiments may include at least one blade 24 extending at least partially over a nose region of the bit body 11, a shoulder region of the bit body 11 and a gage region of the bit body 11 including a contact zone 36 defining a range of about 90% to about 30% of the blade face 20 surface area. Such embodiments may be especially useful for bits used in off-center drilling applications, such as used in certain directional drilling applications.

Figure 4A:
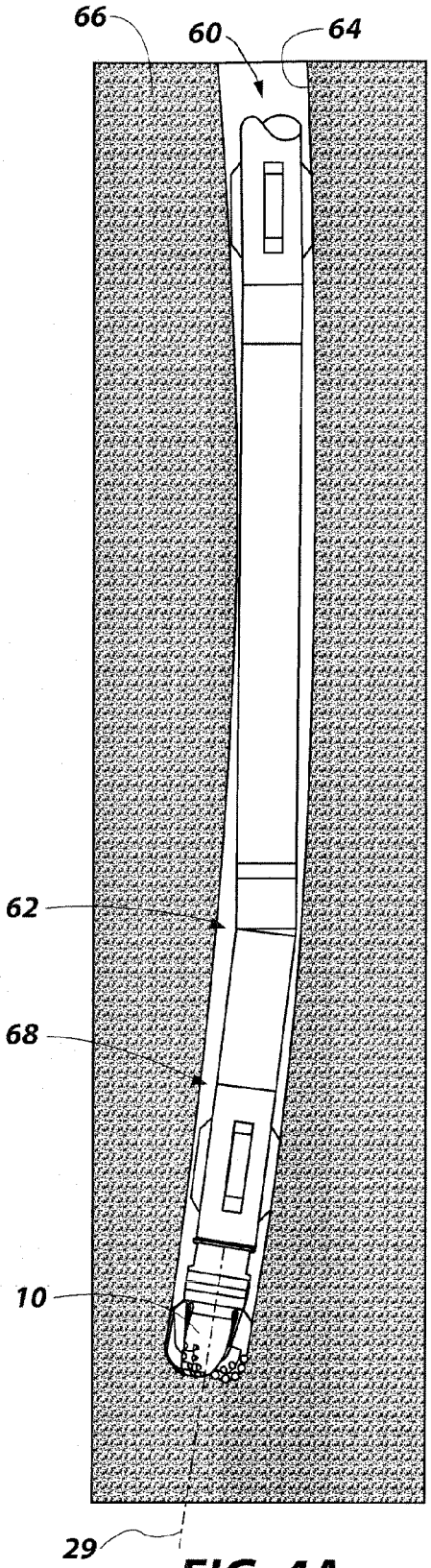
FIG. 4A shows a perspective view of a drill string including the earth-boring drill bit of FIG. 1 positioned within a borehole in a formation and operated in a slide mode.
Figure 4B:
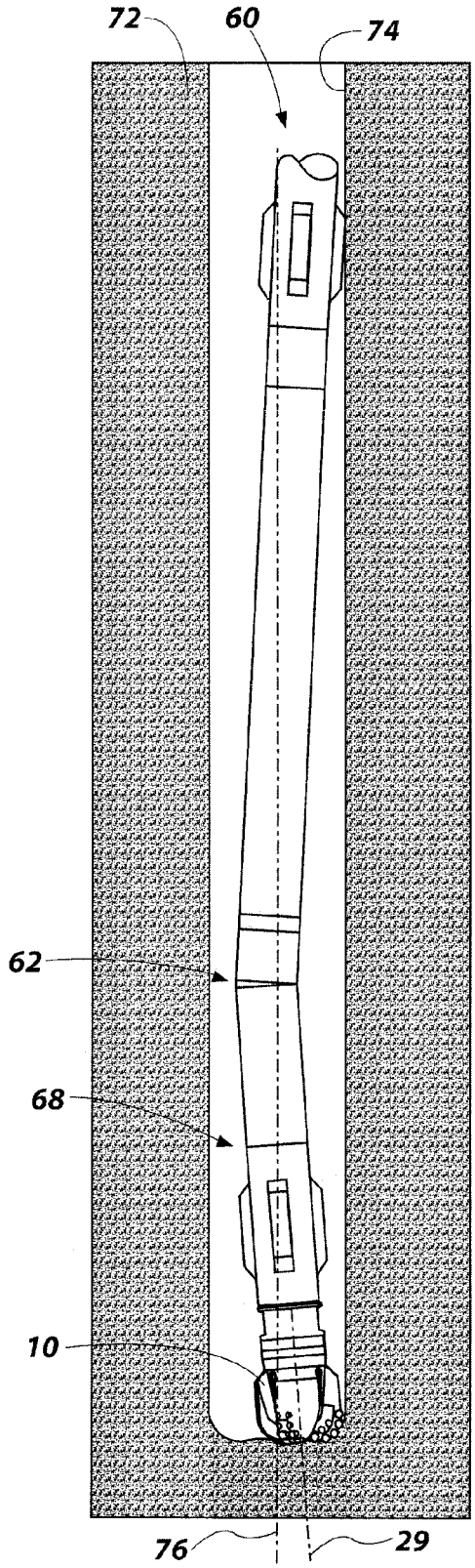
FIG. 4B shows a perspective view of the drill string of FIG. 4A positioned within a borehole in a formation and operated in a rotate mode.

Directional drilling may involve utilizing a bent sub (i.e., a section of the drill string that includes a slight bend angularly offset from the longitudinal axis of the drill string) and a downhole motor that may rotate the drill bit independent of the rotation of the drill string. In view of this, drilling may be performed in "slide mode," (i.e., without rotation of the drill string relative the borehole) to cause the drill bit to drill in the direction of the bend and drilling may be performed in "rotate mode" (i.e., with rotation of the drill string relative the borehole) to cause the drill bit to drill straight ahead. For example, as shown in FIG. 4A, if the drill string 60 includes a bent sub 62 (bend angle greatly exaggerated for clarity) and is operated in slide mode, the interaction between the drill string 60 including the bent sub 62 and the borehole 64 in a formation 66 may cause the drill bit 10, which is rotated only by a downhole motor 68 in the slide mode, to be pushed into, and drill the formation 66 along a curved path. When the drill string 60 is operated in the slide mode, the interaction between the drill bit 10 and the underlying formation 66 may be similar to traditional drilling. For example, the WOB may apply force onto the formation 66 at the bottom of the borehole 64 primarily through the bit face 20, as the drill bit 10 is rotated on-center (i.e., along the longitudinal axis 29 of the drill bit 10) and the majority of the cutting may be performed by the nose and cone region of the drill bit 10. However, while drilling in rotate mode, as shown in FIG. 4B, the WOB and rotation of the drill string 60 may apply force onto the formation 72 at the bottom of the borehole 74 through the shoulder region and a portion of the gage region of the drill bit 10, as well as the nose and cone region of the drill bit 10, as the drill bit 10 is rotated off-center (i.e., along an axis of rotation 76 that is offset from the longitudinal axis 29 of the drill bit 10) by the rotation of the drill string 60. In view of this, as drilling occurs in rotate mode, the portions of the drill bit 10 that may experience significant rubbing may include regions of the drill bit 10 other than the bit face 20, such as the shoulder and gage regions of the drill bit 10. Additionally, the drill bit 10 may experience more significant rubbing forces when rotated off-center, as shown in FIG. 4B, when compared to rotation on-center, as shown in FIG. 4A.

In view of this, drill bits 10 as described herein may be utilized to reduce detrimental rubbing during off-center drilling operations, such as shown in FIG. 4B. In some embodiments, a method of off-center drilling may include positioning a bit body 11 that includes at least one blade 24 extending at least partially over a nose region of the bit body 11, a shoulder region of the bit body 11 and a gage region of the bit body 11, within a borehole 74 in a formation 72. The bit body 11 may then be rotated along an axis of rotation 76 that is different than the longitudinal axis 29 of the bit body 11. For example, the drill bit 10 may be located below a bent sub 62 on a drill string 60 and the drill string 60 may be rotated.

Additionally, the drill bit 10 may also be rotated by the downhole motor 68, along the longitudinal axis 29 of the drill bit 10, while the drill bit 10 is rotated along another axis of rotation 76 by the drill string 60. As the drill bit 10 is rotated, a leading portion of the blade face surface 25 (i.e., the contact zone 36) may be positioned into direct rubbing contact with the formation 72; however, a trailing portion of the blade face surface 25 (i.e., the sweep zone 30) may be prevented from coming into direct rubbing contact with the formation 72. For example, a blade face surface 25 may include a contact zone 36 defining a range of about 90% to about 30% of the blade face surface 25 surface area and a range of about 10% to about 70% of the blade face surface 25 may be prevented from coming into direct rubbing contact with the formation 72.

In additional embodiments, the contact zone 36 may define a range of about 70% to about 50% of the blade face surface 25 surface area and a range of about 30% to about 50% of the blade face surface 25 may be prevented from coming into direct rubbing contact with the formation 72. In further embodiments, the contact zone 36 may define a range of about 65% to about 55% of the blade face surface 25 surface area and a range of about 35% to about 45% of the blade face surface 25 may be prevented from coming into direct rubbing contact with the formation 72. In yet further embodiments, the contact zone 36 may define a range of about 62% to about 60% of the blade face 20 surface area and a range of about 38% to about 40% of the blade face 20 may be prevented from coming into direct rubbing contact with the formation 72. Additionally, the contact zone 36 may extend into the gage region of the drill bit 10 and may prevent a portion of the gage pad 22 from coming into direct rubbing contact with the formation 72.

Figure 5A:
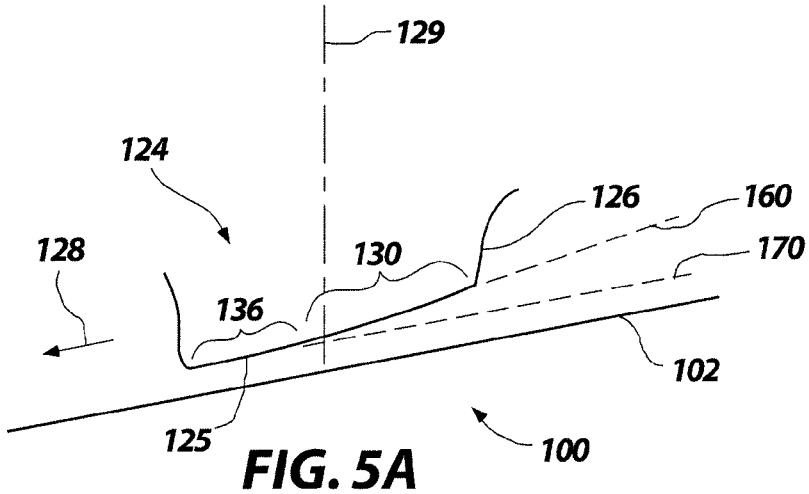
FIGS. 5A through 5C show profiles of sweep zones, in accordance with embodiments of the invention.
Figure 5B:
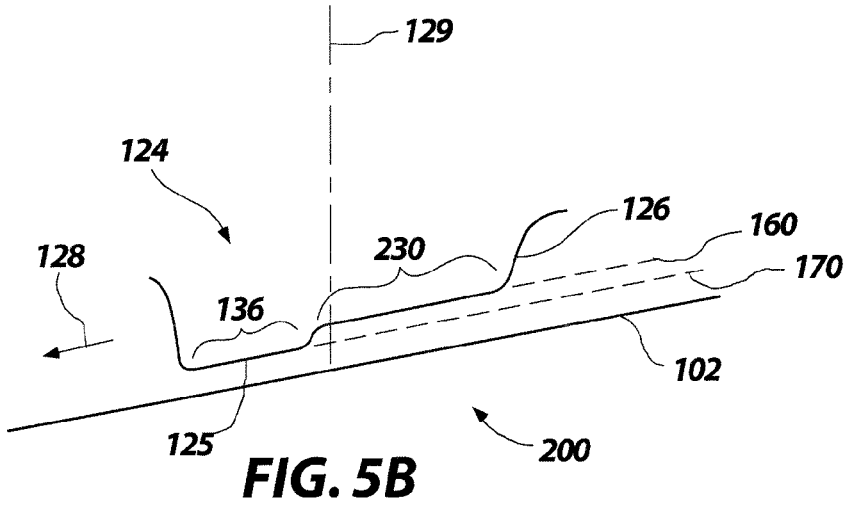
Figure 5C:
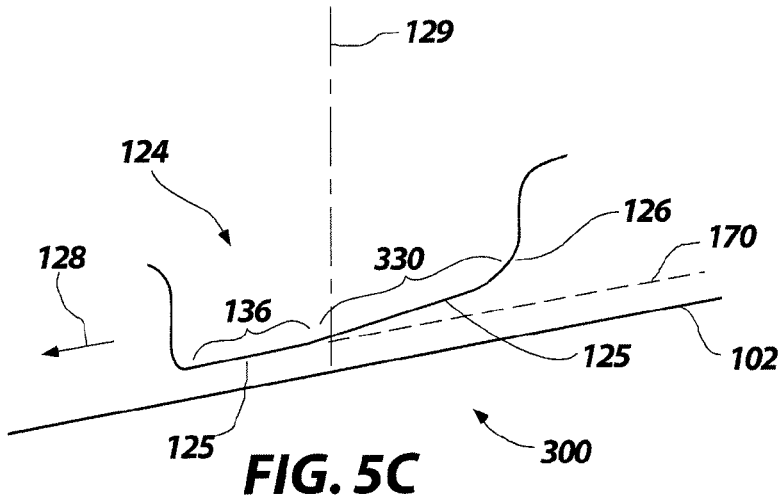

FIGS. 5A through 5C show profiles 100, 200 and 300 of sweep zones 130, 230, 330, respectively, in accordance with embodiments of the invention. The sweep zones 130, 230, 330 are illustrated for a blade 124 of a drill bit (not shown) taken in the direction of drill bit rotation 128 relative to a subterranean formation 102 and at a select radius (not shown) from the centerline 129 of the drill bit. Sweep zones 130, 230, 330 extend from a contact zone 136 on a blade face surface 125 to a rotationally trailing edge, or face 126 of the blade 124.

As shown in FIG. 5A, the sweep zone 130 is uniform across a respective portion of the blade face surface 125 to provide decreased rubbing as illustrated by the divergence between dashed lines 160 and 170.

As shown in FIG. 5B, the sweep zone 230 is stepped across a respective portion of the blade face surface 125 to provide decreased rubbing as illustrated by the offset distance between dashed lines 160 and 170. The sweep zone 230 may have more stepped portions than the stepped portion as illustrated.

As shown in FIG. 5C, the sweep zone 330 is non-linearly contoured across a respective portion of the blade face surface 125 to provide decreased rubbing as illustrated by the divergence from dashed line 170.

While profiles 100, 200 and 300 of sweep zones 130, 230, 330, respectively, have been shown and described, it is contemplated that the profiles 100, 200 and 300 may be combined, or other profiles of various geometric configurations are within the scope of the invention for providing sweep zones capable of decreasing and controlling the extent of rubbing contact between a blade face surface of a drill bit and a subterranean formation while drilling.

In embodiments of the invention, a sweep zone and/or a sweep surface are coextensive with a blade face surface of a blade. In further embodiments of the invention, a sweep zone and/or a sweep surface smoothly form a blade face surface of the blade. In still other embodiments of the invention, a sweep zone and/or a sweep surface are at least one of integral, continuous and unitary with a blade face surface of a blade.

Although this invention has been described with reference to particular embodiments, the invention is not limited to these described embodiments. Rather, the invention is limited only by the appended claims, which include within their scope all equivalent devices and methods according to principles of the invention as described.

What is claimed is:

1. A drill bit for subterranean drilling comprising:

a bit body including a plurality of blades, at least one blade of the plurality of blades extending at least partially over a nose region of the bit body, a shoulder region of the bit body and a gage region of the bit body and including a leading edge at which at least one cutting element is disposed; and the at least one blade of the plurality of blades having a blade face surface comprising a contact zone extending from the leading edge and a sweep zone, the sweep zone rotationally trailing the contact zone with respect to a direction of intended bit rotation about a longitudinal axis of the bit body, the contact zone defining a range of about 90% to about 30% of an area of the blade face surface.

2. The drill bit of claim 1, wherein the contact zone defines a range of about 70% to about 50% of the area of the blade face surface.

3. The drill bit of claim 2, wherein the contact zone defines a range of about 65% to about 55% of the area of the blade face surface.

4. The drill bit of claim 3, wherein the contact zone defines a range of about 62% to about 60% of the area of the blade face surface.

5. The drill bit of claim 1, wherein the sweep zone rotationally trails the contact zone to a lesser radial extent and lesser lateral extent than a radial extent and lateral extent of the contact zone.

6. The drill bit of claim 1, wherein the sweep zone comprises a plurality of sweep surfaces.

7. The drill bit of claim 6, wherein at least two sweep surfaces of the plurality of sweep surfaces are at least one of adjacently located, segmented, and disposed to a different radial extent and a different longitudinal extent.

8. The drill bit of claim 1, wherein the sweep zone comprises at least one of a non-linear surface, a uniform surface, a non-uniform surface, a stepped surface, and an irregular surface.

9. The drill bit of claim 1, wherein the sweep zone and the contact zone are bounded by a sweep demarcation line.

10. The drill bit of claim 1, wherein the bit body includes a plurality of blades, each blade of the plurality having a blade face surface and a plurality of cutting elements disposed thereon, each blade face surface of each blade of the plurality comprising a contact zone and a sweep zone rotationally trailing the contact zone.

11. The drill bit of claim 10, wherein the contact zone and the sweep zone of each blade of the plurality are rotationally oriented substantially symmetrically about the bit body.

12. The drill bit of claim 1, wherein the plurality of blades comprises a plurality of blades circumferentially separated by junk slots.

13. The drill bit of claim 1, further including a plurality of additional blades, at least one of the additional blades having no sweep zone associated therewith.

14. The drill bit of claim 1, wherein the sweep zone extends to a trailing edge of the at least one blade of the plurality of blades.

15. A drill bit for subterranean drilling comprising:

a bit body including a plurality of blades, at least one blade of the plurality of blades extending at least partially over a nose region of the bit body, a shoulder region of the bit body and a gage region of the bit body and including a leading edge at which at least one cutting element is disposed and a trailing edge; and the at least one blade of the plurality of blades having a blade face surface comprising a contact zone extending from the leading edge and a sweep zone extending to the trailing edge and rotationally trailing the contact zone with respect to a direction of intended bit rotation about a longitudinal axis of the bit body, the sweep zone located at least partially within the gage region of the bit body.

16. A method of off-center drilling comprising:

positioning a drill bit including a bit body, a longitudinal axis and at least one blade of a plurality of blades extending at least partially over a nose region of the bit body, a shoulder region of the bit body and a gage region of the bit body, within a borehole in a formation;

rotating the bit body along an axis of rotation that is offset from the longitudinal axis of the drill bit; and positioning a leading portion of a blade face surface of the at least one blade comprising a contact zone extending from a leading edge at which at least one cutting element is disposed into direct rubbing contact with the formation while preventing a trailing portion of the blade face surface of the at least one blade comprising a sweep zone extending to a trailing edge of the at least one blade and located at least partially within the gage region of the bit body from coming into direct rubbing contact with the formation.

17. The method of claim 16, wherein preventing a trailing portion of the blade face surface of the at least one blade comprising a sweep zone extending to a trailing edge of the at least one blade and located at least partially within the gage region of the bit body from coming into direct rubbing contact with the formation further comprises preventing a range of about 10% to about 70% of the blade face surface from coming into direct rubbing contact with the formation.

18. The method of claim 17, wherein preventing a trailing portion of the blade face surface from coming into direct rubbing contact with the formation further comprises preventing a range of about 30% to about 50% of the blade face surface from coming into direct rubbing contact with the formation.

19. The method of claim 18, wherein preventing a trailing portion of the blade face surface from coming into direct rubbing contact with the formation further comprises preventing a range of about 35% to about 45% of the blade face surface from coming into direct rubbing contact with the formation.

20. The method of claim 19, wherein preventing a trailing portion of the blade face surface from coming into direct rubbing contact with the formation further comprises preventing a range of about 38% to about 40% of the blade face surface from coming into direct rubbing contact with the formation.

21. The method of claim 16, further comprising rotating the drill bit along the longitudinal axis thereof while rotating the drill bit along the axis of rotation that is offset from the longitudinal axis of the drill bit.

22. A method of manufacturing a drill bit comprising:

forming at least one blade of a plurality of blades at least partially over a nose region of a bit body, a shoulder region of the bit body and a gage region of the bit body; and forming a blade face surface of the at least one blade to comprise a contact zone extending from a leading edge of the at least one blade at which at least one cutting element is disposed and a sweep zone extending to a trailing edge of the at least one blade rotationally trailing the contact zone with respect to a direction of intended bit rotation about a longitudinal axis of the bit body in at least a portion of the gage region of the bit body.

23. A method of manufacturing a drill bit comprising:

forming at least one blade of a plurality of blades at least partially over a nose region of a bit body, a shoulder region of the bit body and a gage region of the bit body; and forming a blade face surface on the at least one blade comprising a contact zone extending from a leading edge of the at least one blade at which at least one cutting element is disposed and forming a range of about 90% to about 30% of the blade face surface and a sweep zone, the sweep zone rotationally trailing the contact zone with respect to a direction of intended bit rotation about a longitudinal axis of the bit body.

24. The method of claim 23, wherein forming a blade face surface in the at least one blade comprising a contact zone extending from a leading edge of the at least one blade at which at least one cutting element is disposed and forming a range of about 90% to about 30% of the blade face surface comprises forming a blade face surface on the at least one blade comprising a contact zone extending from a leading edge of the at least one blade at which at least one cutting element is disposed and forming a range of about 70% to about 50% of the blade face surface.

25. The method of claim 24, wherein forming a blade face surface in the at least one blade comprising a contact zone extending from a leading edge of the at least one blade at which at least one cutting element is disposed and forming a range of about 70% to about 50% of the blade face surface comprises forming a blade face surface on the at least one blade comprising a contact zone extending from a leading edge of the at least one blade at which at least one cutting element is disposed and forming a range of about 65% to about 55% of the blade face surface.

26. The method of claim 25, wherein forming a blade face surface in the at least one blade comprising a contact zone extending from a leading edge of the at least one blade at which at least one cutting element is disposed and forming a range of about 65% to about 55% of the blade face surface comprises forming a blade face surface on the at least one blade comprising a contact zone extending from a leading edge of the at least one blade at which at least one cutting element is disposed and forming a range of about 62% to about 60% of the blade face surface.

* * * * *